US009091280B2

(12) United States Patent
Hopkins

(10) Patent No.: US 9,091,280 B2
(45) Date of Patent: Jul. 28, 2015

(54) METHODS AND SYSTEMS FOR ACTIVE SOUND ATTENUATION IN AN AIR HANDLING UNIT

(75) Inventor: Lawrence G. Hopkins, Happy Valley, OR (US)

(73) Assignee: Nortek Air Solutions, LLC, Eden Prairie, MN (US)

( * ) Notice: Subject to any disclaimer, the term of this patent is extended or adjusted under 35 U.S.C. 154(b) by 951 days.

(21) Appl. No.: 13/044,695

(22) Filed: Mar. 10, 2011

(65) Prior Publication Data

US 2011/0255704 A1 Oct. 20, 2011

Related U.S. Application Data

(60) Provisional application No. 61/324,634, filed on Apr. 15, 2010.

(51) Int. Cl.

| | |
|---|---|
| ***G10K 11/16*** | (2006.01) |
| ***H03B 29/00*** | (2006.01) |
| ***A61F 11/06*** | (2006.01) |
| ***F04D 29/66*** | (2006.01) |

(52) U.S. Cl.

CPC ..... *F04D 29/663* (2013.01); *F04D 29/665* (2013.01)

(58) Field of Classification Search

CPC ..... H04R 3/005; H04R 29/00; H04R 1/1083; H04R 2499/13; G10K 11/1788; G10K 11/178; G10K 2210/1282; G10K 11/1784; G10K 2210/1081; G10K 11/1786; G10K 2210/112; G10K 11/175

USPC ..... 381/71.3, 71.1, 71.2, 71.4, 71.5, 71.8, 381/56, 57

See application file for complete search history.

(56) References Cited

U.S. PATENT DOCUMENTS

| | | | |
|---|---|---|---|
| 4,865,832 | A | 9/1989 | Kamijyo |
| 4,965,832 | A | 10/1990 | Edwards |

(Continued)

FOREIGN PATENT DOCUMENTS

| | | |
|---|---|---|
| CN | 1180980 | 5/1998 |
| CN | 1333419 | 1/2002 |

(Continued)

OTHER PUBLICATIONS

International Search Report and Written Opinion for counterpart PCT/US2011/027826, mailed Nov. 9, 2011.

(Continued)

*Primary Examiner* — Paul S Kim

(74) *Attorney, Agent, or Firm* — Joseph M. Butscher; The Small Patent Law Group, LLC

(57) ABSTRACT

A system and method for controlling noise produced by an air handling system is provided. The system includes a source microphone to collect sound measurements from the air handling system and a processor to define a cancellation signal that at least partially cancels out the sound measurements. The system also includes a speaker to generate the cancellation signal. The sound measurements are at least partially canceled out within a region of cancellation. Accordingly, the system further includes a response microphone to collect response sound measurements at the region of cancellation. The processor tunes the cancellation signal based on the response sound measurements.

51 Claims, 12 Drawing Sheets

(56) References Cited

U.S. PATENT DOCUMENTS

| | | | | |
|---|---|---|---|---|
| 5,448,645 | A | 9/1995 | Guerci | |
| 5,515,444 | A | 5/1996 | Burdisso | |
| 5,832,095 | A | 11/1998 | Daniels | |
| 6,049,615 | A | 4/2000 | Chou | |
| 6,118,878 | A * | 9/2000 | Jones | 381/72 |
| 7,001,140 | B2 | 2/2006 | Hustvedt | |
| 7,317,801 | B1 | 1/2008 | Amir | |
| 7,357,621 | B2 | 4/2008 | Hustvedt | |
| 7,783,055 | B2 | 8/2010 | Barath | |
| 7,853,024 | B2 | 12/2010 | Slapak | |
| 7,869,607 | B2 | 1/2011 | Barath | |
| 2003/0112981 | A1 | 6/2003 | McWilliam | |
| 2004/0066940 | A1 | 4/2004 | Amir | |
| 2004/0194776 | A1 | 10/2004 | Amir | |
| 2005/0207585 | A1 | 9/2005 | Christoph | |
| 2008/0142294 | A1 * | 6/2008 | Cheng et al. | 181/206 |
| 2008/0162072 | A1 | 7/2008 | Copley | |
| 2010/0002385 | A1 | 1/2010 | Lyon | |
| 2010/0002890 | A1 * | 1/2010 | Lyon et al. | 381/71.5 |
| 2010/0014685 | A1 * | 1/2010 | Wurm | 381/71.11 |
| 2010/0028134 | A1 | 2/2010 | Slapak | |
| 2011/0116645 | A1 | 5/2011 | Slapak | |

FOREIGN PATENT DOCUMENTS

| | | |
|---|---|---|
| CN | 1755146 | 4/2006 |
| DE | 4421803 | 1/1996 |
| EP | 0619461 | 10/1994 |
| EP | 0 715 131 | 6/1996 |
| EP | 1 342 910 | 9/2003 |
| EP | 1342910 | 9/2003 |
| EP | 1357540 | 10/2003 |
| JP | 5-232968 | 9/1993 |
| JP | 5-289677 | 11/1993 |
| JP | 10-143167 | 5/1998 |
| JP | 11-101492 | 4/1999 |
| JP | 2003-184799 | 7/2003 |
| JP | 2005 009377 | 1/2005 |
| JP | 2005 171838 | 6/2005 |
| KR | 1994-0004114 | 7/1993 |
| KR | 0111191 | 3/1996 |
| WO | WO 2009/054429 | 4/2009 |

OTHER PUBLICATIONS

International Preliminary Report on Patentability for counterpart application PCT/US2011/027826, issued Oct. 16, 2012.

The AcoustiFLO Modular Fan Model 686q Operation and Maintenance Manual.

"Implementation of Active Noise Control Into Different Fan Applications," Schneider, et al., Fan 2012, Apr. 2012.

"25 Years Ago, Active Control First Appeared as a Great Solution for Fan Noise. What Has Happened?" Wise, Fan 2012, Apr. 2012.

"Present and Future for Active Control of Fan Noise: Treatment at Source and in the Duct" Leventhall, et al., Fan Noise 2003, Sep. 2003.

Machine translation of JP2005171838.

* cited by examiner

METHODS AND SYSTEMS FOR ACTIVE SOUND ATTENUATION IN AN AIR HANDLING UNIT

CROSS REFERENCE TO RELATED APPLICATION

The present application relates to and claims priority from Provisional Application Ser. No. 61/324,634 filed Apr. 15, 2010, titled "METHODS AND SYSTEMS FOR ACTIVE SOUND ATTENUATION IN AN AIR HANDLING UNIT", the complete subject matter of which is hereby expressly incorporated by reference in its entirety.

BACKGROUND OF THE INVENTION

Embodiments relate to air handling units and, more particularly, to methods and systems for active sound attenuation in an air handling unit.

Air-handling systems (also referred to as air handlers) have traditionally been used to condition buildings or rooms (hereinafter referred to as "structures"). An air-handling system may contain various components such as cooling coils, heating coils, filters, humidifiers, fans, sound attenuators, controls, and other devices functioning to at least meet a specified air capacity which may represent all or only a portion of a total air handling requirement of the structure. The air-handling system may be manufactured in a factory and brought to the structure to be installed or it may be built on site using the appropriate devices to meet the specified air capacity. The air-handling compartment of the air-handling system includes the fan inlet cone and the discharge plenum. Within the air-handling compartment is situated the fan unit including an inlet cone, a fan, a motor, fan frame, and any appurtenance associated with the function of the fan (e.g. dampers, controls, settling means, and associated cabinetry). The fan includes a fan wheel having at least one blade. The fan wheel has a fan wheel diameter that is measured from one side of the outer periphery of the fan wheel to the opposite side of the outer periphery of the fan wheel. The dimensions of the air handling compartment such as height, width, and airway length are determined by consulting fan manufacturers data for the type of fan selected.

During operation, each fan unit produces sounds at frequencies. In particular, smaller fan units typically emit sound power at higher audible frequencies, whereas larger fan units emit more sound power at lower audible frequencies. Devices have been proposed in the past that afford passive sound attenuation such as with acoustic tiles or sound barriers that block or reduce noise transmission. The acoustic tiles include a soft surface that deadens reflected sound waves and reverberation of the fan unit.

However, passive sound attenuation devices generally affect noise transmission in certain directions relative to the direction of air flow.

A need remains for improved systems and methods to provide sound attenuation in air handling systems.

SUMMARY OF THE INVENTION

In one embodiment, a method for controlling noise produced by an air handling system is provided. The method includes collecting sound measurements from the air handling system, wherein the sound measurements are defined by acoustic parameters. Values for the acoustic parameters are determined based on the sound measurements collected. Offset values for the acoustic parameters are calculated to define a cancellation signal that at least partially cancels out the sound measurements when the cancellation signal is generated. The acoustic parameters may include a frequency and amplitude of the sound measurements. Optionally, the cancellation signal includes an opposite phase and matching amplitude of the acoustic parameters. Optionally, response sound measurements are collected at a region of cancellation and the cancellation signal is tuned based on the response sound measurements.

In another embodiment, a system for controlling noise produced by an air handling system is provided. The system includes a source microphone to collect sound measurements from the air handling system and a processor to define a cancellation signal that at least partially cancels out the sound measurements. The system also includes a speaker to generate the cancellation signal. Optionally, the speaker generates the cancellation signal in a direction opposite the sound measurements. Optionally, the sound measurements are at least partially canceled out within a region of cancellation and the system further includes a response microphone to collect response sound measurements at the region of cancellation. Optionally, the processor tunes the cancellation signal based on the response sound measurements.

In another embodiment, a fan unit for an air handling system is provided. The fan unit includes a source microphone to collect sound measurements from the fan unit. A module defines a cancellation signal that at least partially cancels out the sound measurements. A speaker generates the cancellation signal.

DETAILED DESCRIPTION OF THE DRAWINGS

Figure 1:
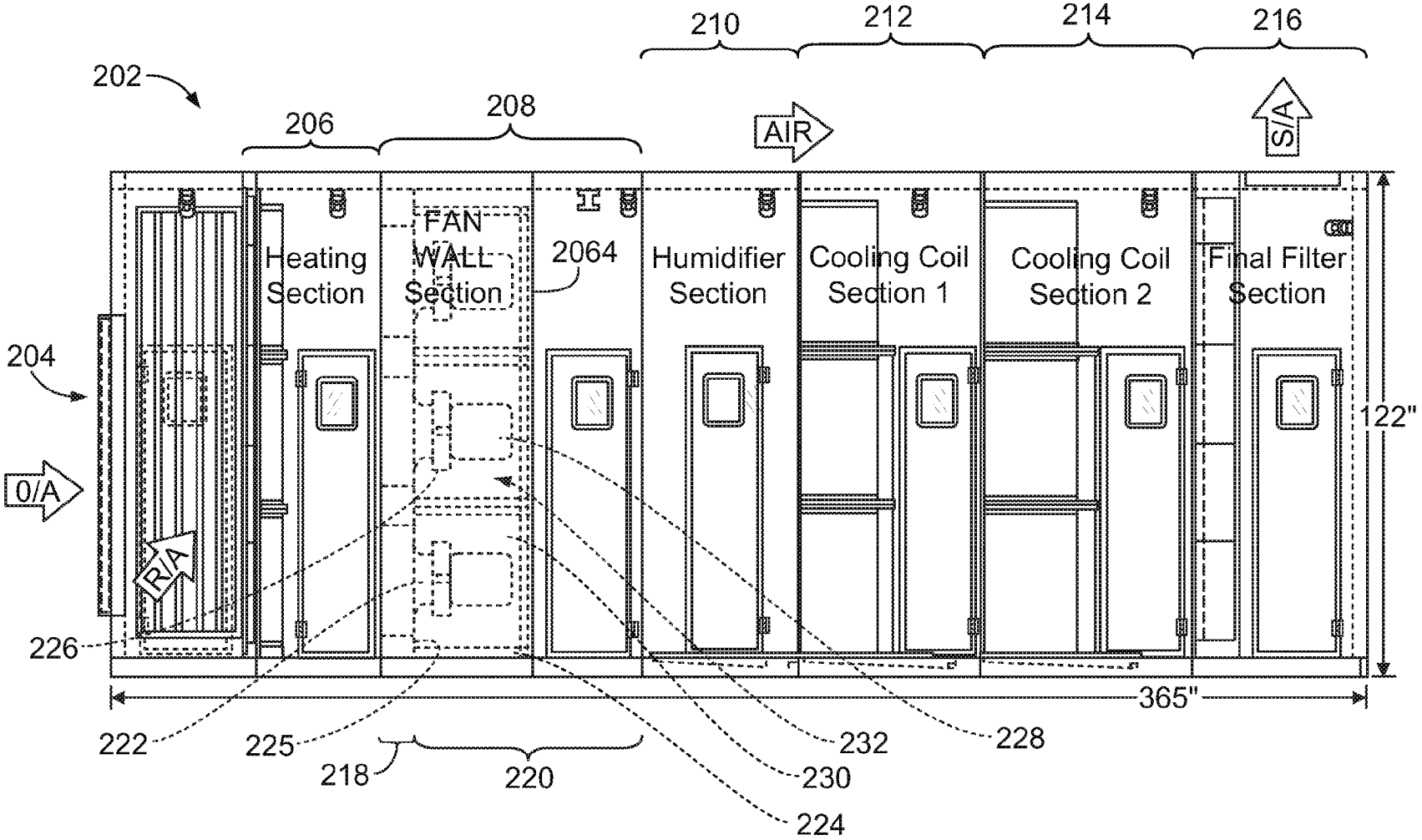
FIG. 1 is a perspective view of an air handler in accordance with an embodiment.

The foregoing summary, as well as the following detailed description of certain embodiments will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (e.g., processors or memories) may be implemented in a single piece of hardware (e.g., a general purpose signal processor or random access memory, hard disk, or the like) or multiple pieces of hardware. Similarly, the programs may be stand alone programs, may be incorporated as subroutines in an operating system, may be functions in an installed software package, and the like. It should be understood that the various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

FIG. 1 illustrates an air processing system 202 that utilizes a fan array air handling system in accordance with an embodiment of the present invention. The system 202 includes an inlet 204 that receives air. A heating section 206 that heats the air is included and followed by an air handling section 208. A humidifier section 210 is located downstream of the air handling section 208. The humidifier section 210 adds and/or removes moisture from the air. Cooling coil sections 212 and 214 are located downstream of the humidifier section 210 to cool the air. A filter section 216 is located downstream of the cooling coil section 214 to filter the air. The sections may be reordered or removed. Additional sections may be included.

The air handling section 208 includes an inlet plenum 218 and a discharge plenum 220 that are separated from one another by a bulkhead wall 225 which forms part of a frame 224. Fan inlet cones 222 are located proximate to the bulkhead 225 of the frame 224 of the air handling section 208. The fan inlet cones 222 may be mounted to the bulkhead wall 225. Alternatively, the frame 224 may support the fan inlet cones 222 in a suspended location proximate to, or separated from, the bulkhead wall 225. Fans 226 are mounted to drive shafts on individual corresponding motors 228. The motors 228 are mounted on mounting blocks to the frame 224. Each fan 226 and the corresponding motor 228 form one of the individual fan units 232 that may be held in separate chambers 230. The chambers 230 are shown vertically stacked upon one another in a column. Optionally, more or fewer chambers 230 may be provided in each column. One or more columns of chambers 230 may be provided adjacent one another in a single air handling section 208.

Figure 2:
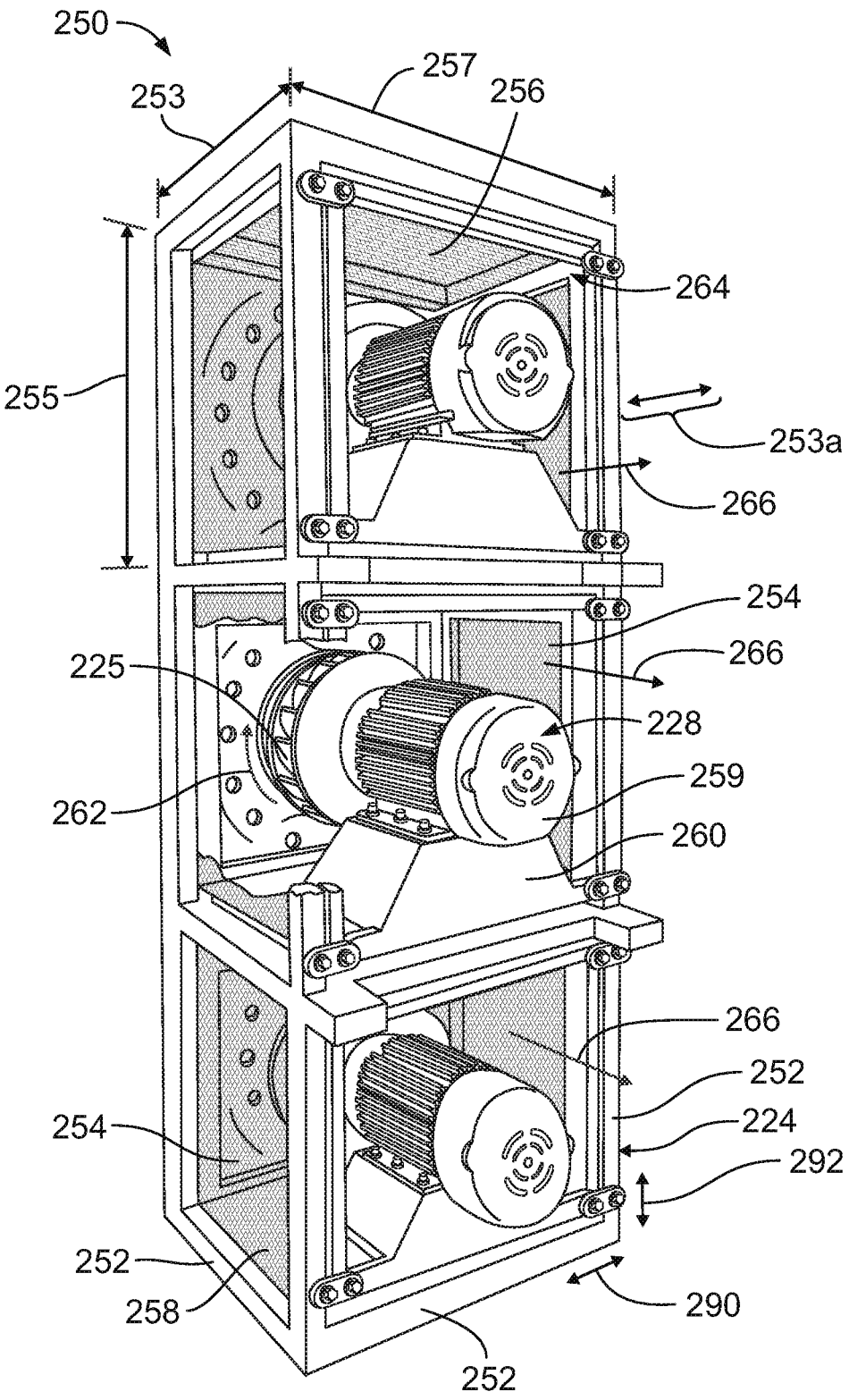
FIG. 2 is a perspective view of a stack of the fan arrays in accordance with an embodiment.

FIG. 2 illustrates a side perspective view of a column 250 of chambers 230 and corresponding fan units 232 therein. The frame 224 includes edge beams 252 extending horizontally and vertically along the top, bottom and sides of each chamber 230. Side panels 254 are provided on opposite sides of at least a portion of the fan unit 232. Top and bottom panels 256 and 258 are provided above and below at least a portion of the fan units 232. The top and bottom panels 256 may be provided above and below each fan unit 232. Alternatively, panels 256 may be provided above only the uppermost fan unit 232, and/or only below the lowermost fan unit 232. The motors are mounted on brackets 260 which are secured to the edge beams 252. The fans 226 are open sided plenum fans that draw air inward along the rotational axis of the fan and radially discharge the air about the rotational axis in the direction of arrow 262. The air then flows from the discharge end 264 of each chamber 230 in the direction of arrows 266.

The top, bottom and side panels 256, 258 and 254 have a height 255, a width 257 and a length 253 that are sized to form chambers 230 with predetermined volume and length. FIG. 2 illustrates the length 253 to substantially correspond to a length of the fan 226 and motor 228. Optionally, the length 253 of each chamber 230 may be longer than the length of the fan 226 and motor 228 such that the top, bottom and side panels 256, 258 and 254 extend beyond a downstream end 259 of the motors 228. For example, the panels 254, 256 and 258 may extend a distance, denoted by bracket 253*a*, beyond the downstream end 259 of the motor 228.

Figure 3:
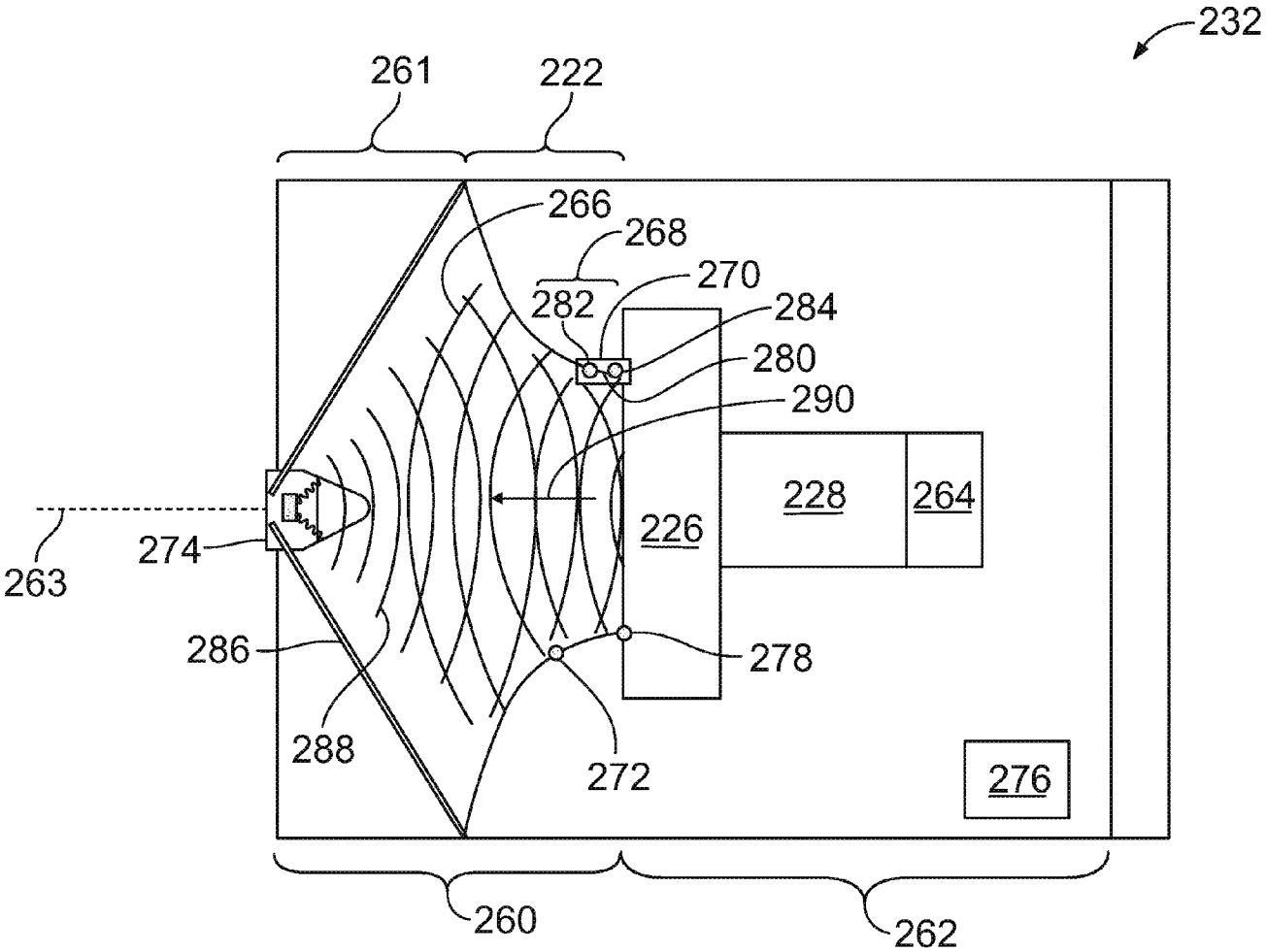
FIG. 3 is a schematic view of a fan unit in accordance with an embodiment.

FIG. 3 is a schematic view of an individual fan unit 232. The fan unit includes a fan 226 that is driven by a motor 228. An inlet cone 222 is coupled upstream of the fan 226 and includes a center axis 263. The fan unit 232 includes an upstream region 260 and a downstream region 262. A motor controller 264 is positioned adjacent the motor 228. Optionally, the motor controller 264 may be located adjacent one of top, bottom and side panels 256, 258 and 254, as shown in FIG. 2, and/or remote from the fan unit 232.

During operation, the motor 228 rotates the fan 226 to draw air through the inlet cone 222 from an inlet plenum 261 toward the downstream region 262. It should be noted that with respect to airflow, "upstream" is defined as traveling from the fan 226 to the inlet cone 222 and "downstream" is defined as traveling from the inlet cone 222 to the fan 226. The motor controller 264 may adjust a speed of the fan 226 to reduce or increase an amount of air flow through the fan unit 232. Noise may travel both upstream 260 and downstream 262 from the fan unit 232. The noise may include fan noise generated by vibrations or friction in the fan 226 or motor 228 among other things. The noise may also include environmental noise generated outside the fan unit 232. Both the fan noise and the environmental noise have acoustic parameters including frequency, wavelength, period, amplitude, intensity, speed, and direction. The noise travels in a noise vector 266.

The fan unit 232 includes active sound attenuation to reduce the fan noise within a region of active cancellation 268. The region of active cancellation 268 is in the throat 269 of the inlet cone 222. Optionally, the region of active cancellation 268 may be upstream from the inlet cone 222. In the exemplary embodiment, the region of active cancellation 268 is located in the upstream region 260. Optionally, the region of active cancellation 268 may be located in the downstream region 262. The active sound attenuation may reduce any one of the acoustic parameters to approximately zero using destructive interference. Destructive interference is achieved by the superposition of a sound waveform onto a original sound waveform to eliminate the original sound waveform by reducing or eliminating one of the acoustic parameters of the original waveform. In an exemplary embodiment, the amplitude of the noise vector 266 is reduced or substantially eliminated. Optionally, any of the acoustic parameters of the noise vector 266 may be eliminated.

Active sound attenuation is enabled by a source microphone 270, a response microphone 272, a speaker 274, and an attenuation module 276. The source microphone 270 is positioned within the inlet cone 222. The source microphone 270 is configured to detect the noise vector 266. The step of detecting the noise vector 266 includes obtaining sound measurements having acoustic parameters. For example, a sound pressure of the noise vector 266 may be obtained to determine the acoustic parameters. The source microphone 270 may be positioned at the juncture 278 of the inlet cone 222 and the fan 226. Optionally, the source microphone 270 may be positioned along any portion of inlet cone 222 or upstream from the inlet cone 222. In the exemplary embodiment, the source microphone 270 is located flush with an inner surface 280 of the inlet cone 222 to reduce disturbances in air flow through the inlet cone 222. Optionally, the source microphone 270 may extend toward the center axis 263 on a boom or bracket.

In the exemplary embodiment, the source microphone 270 includes a pair of microphones configured to bias against environmental noise. Optionally, the source microphone may only include one microphone. The pair of microphones includes a downstream microphone 282 and an upstream microphone 284. Optionally, source microphone 270 may include a plurality of microphones configured to bias against environmental noise. In one embodiment, the upstream microphone 284 may be positioned approximately 50 mm from the downstream microphone 282. Optionally, microphones 282 and 284 may have any suitable spacing. Further, in the exemplary embodiment, microphone 282 is positioned in approximately the same circumferential location as microphone 284. Optionally, microphones 282 and 284 may be positioned within different circumferential locations of the inlet cone 222.

Microphones 282 and 284 bias against environmental noise so that only fan noise is attenuated. Environmental noise is detected by the upstream microphone 284 and the downstream microphone 282 at substantially the same time. However, a time delay exists between downstream microphone 282 sensing the fan noise and upstream microphone 284 sensing the fan noise. Accordingly, the fan noise can be distinguished from the environmental noise and the environmental noise is removable from the noise vector 266.

The speaker 274 is positioned upstream from the inlet cone 222. The speaker 274 may be fabricated from a perforated foam or metal. For example, the speaker 274 may be fabricated from acoustically transparent foam. In an embodiment, the speaker 274 has an aerodynamic shape that has a limited effect on the fan performance. For example, the speaker 274 may be domed-shaped. In the exemplary embodiment, the speaker 274 is mounted on a tripod or similar mount 286. Optionally, the speaker 274 may be coupled to one of panels 254, 256 and 258 or to frame 224. Additionally, the speaker 274 may be positioned upstream of the fan unit and configured to attenuate noise within the entire fan unit. The speaker 274 is aligned with the center axis 263 of the inlet cone 222. Optionally, the speaker 274 may be offset from the center axis 263. The speaker 274 may also be angled toward the center axis 263. The speaker 274 transmits an attenuation vector 288 downstream and opposite the noise vector 266. The attenuation vector 288 is an inverted noise vector 266 having an opposite phase and matching amplitude of the noise vector 266. The attenuation vector 288 destructively interferes with the noise vector 266 to generate an attenuated noise vector 290 having an amplitude of approximately zero. Optionally, the attenuating vector 288 reduces any of the noise vector acoustic parameters so that the attenuated noise vector 290 is inaudible.

The response microphone 272 is positioned upstream of the source microphone 270 and within the region of active cancellation 268. The response microphone 272 is located flush along the inner surface 280 of the inlet cone 222. Optionally, the response microphone 272 may extend toward the center axis 263 on a boom or bracket. Additionally, the response microphone 272 may be positioned in the inlet plenum 261 and/or upstream of the fan unit 232. The response microphone 272 is configured to detect the attenuated noise vector 266. Detecting the attenuated noise vector 290 includes obtaining sound measurements having acoustic parameters. For example, a sound pressure of the attenuated noise vector 290 may be obtained to determine the acoustic parameters. As described in more detail below, the attenuated noise vector 290 is compared to the noise vector 266 to determine whether the noise vector 266 has been reduced or eliminated.

Typically, the noise vector 266 remains dynamic throughout the operation of the fan unit 232. Accordingly, the attenuation vector 288 must be modified to adapt to changes in the noise vector 266. The attenuating module 276 is positioned within the fan unit 232 to modify the attenuation vector 288. Optionally, the attenuating module 276 may be positioned within the air processing system 200 or may be remote therefrom. The attenuating module 276 may be programmed internally or configured to operate software stored on a computer readable medium.

Figure 4:
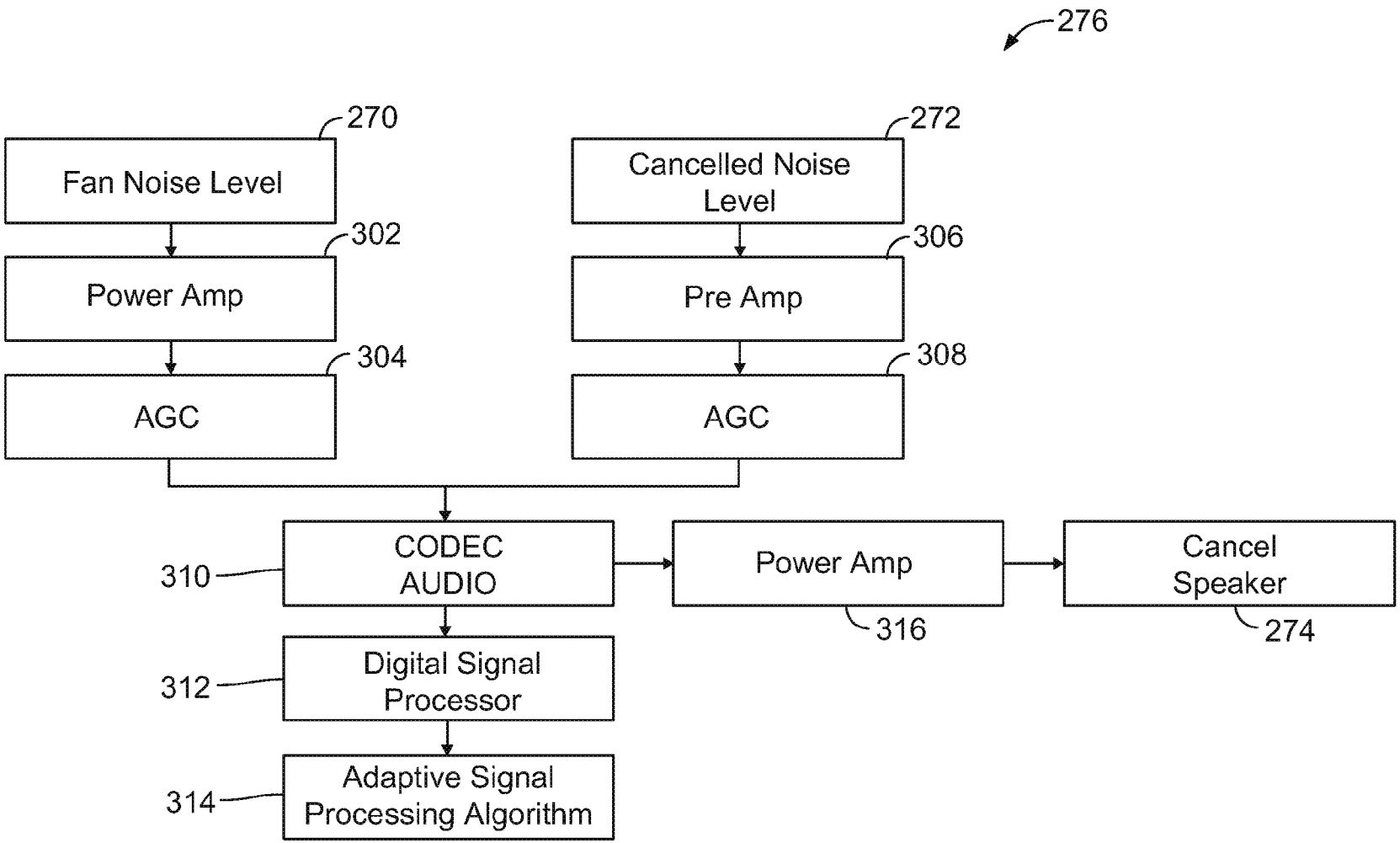
FIG. 4 is a flowchart of a method for a dynamic feedback loop in accordance with an embodiment.

FIG. 4 is a block diagram of the attenuating module 276 electronically coupled to the source microphone 270 and the response microphone 272. The attenuating module 276 includes an amplifier 302 and an automatic gain control 304 to modify the noise vector 266 detected by the source microphone 270. Likewise, an amplifier 306 and an automatic gain control 308 modify the attenuated noise vector 290 detected by the response microphone 272. A CODEC 310 digitally encodes the noise vector 266 and the attenuated noise vector 290. A digital signal processor 312 obtains the acoustic parameters of each vector 266 and 290. The vectors are compared utilizing an adaptive signal processing algorithm 314 to determine whether the noise vector 266 has been attenuated. Based on the comparison, the attenuation module 276 modifies the attenuation vector 288, which is digitally decoded by the CODEC 310, transmitted to an amplifier 316, and transmitted by the speaker 274.

Figure 5:
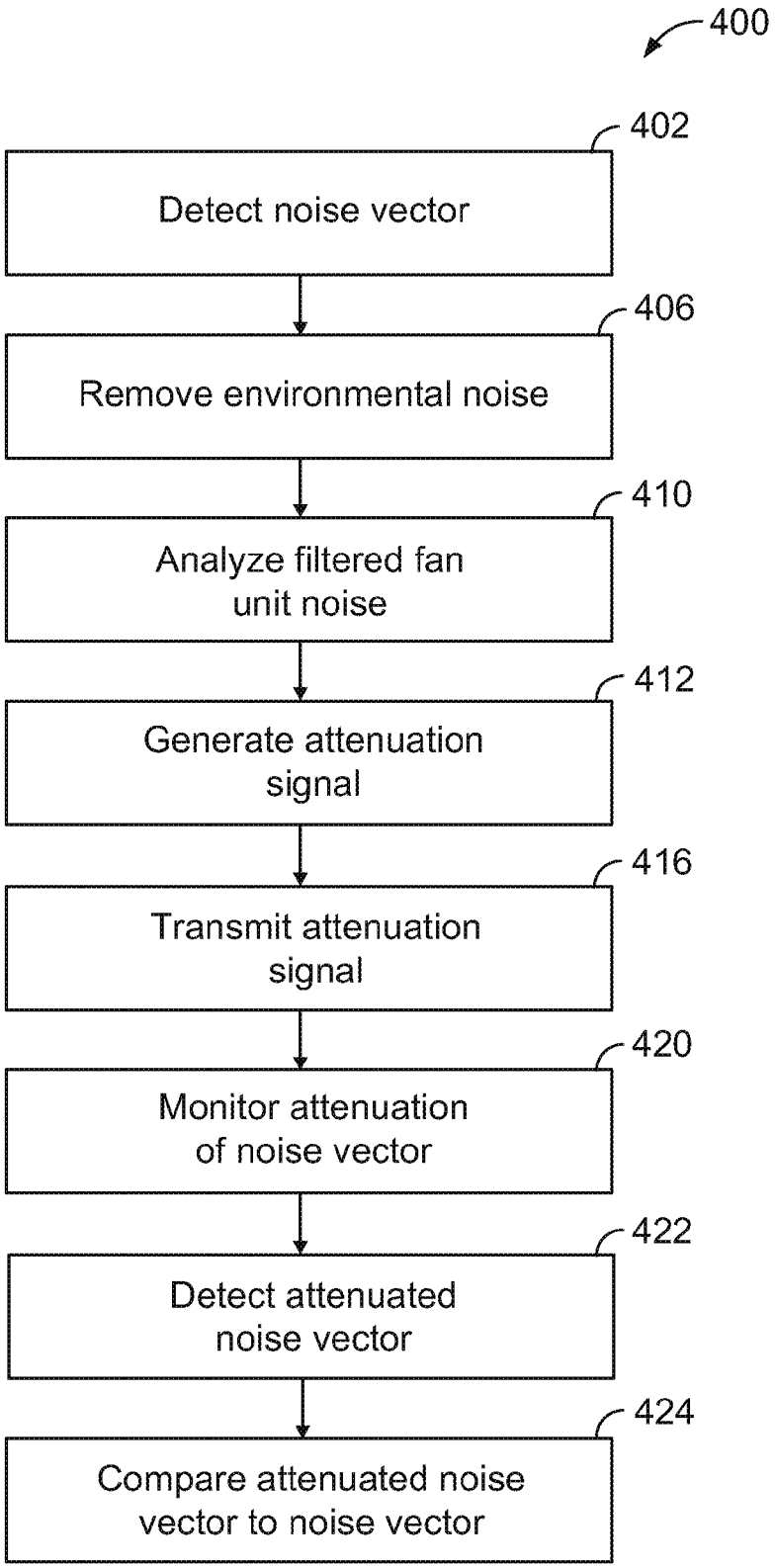
FIG. 5 is a flowchart of a method for providing active sound attenuation in accordance with an embodiment.
Figure 6:
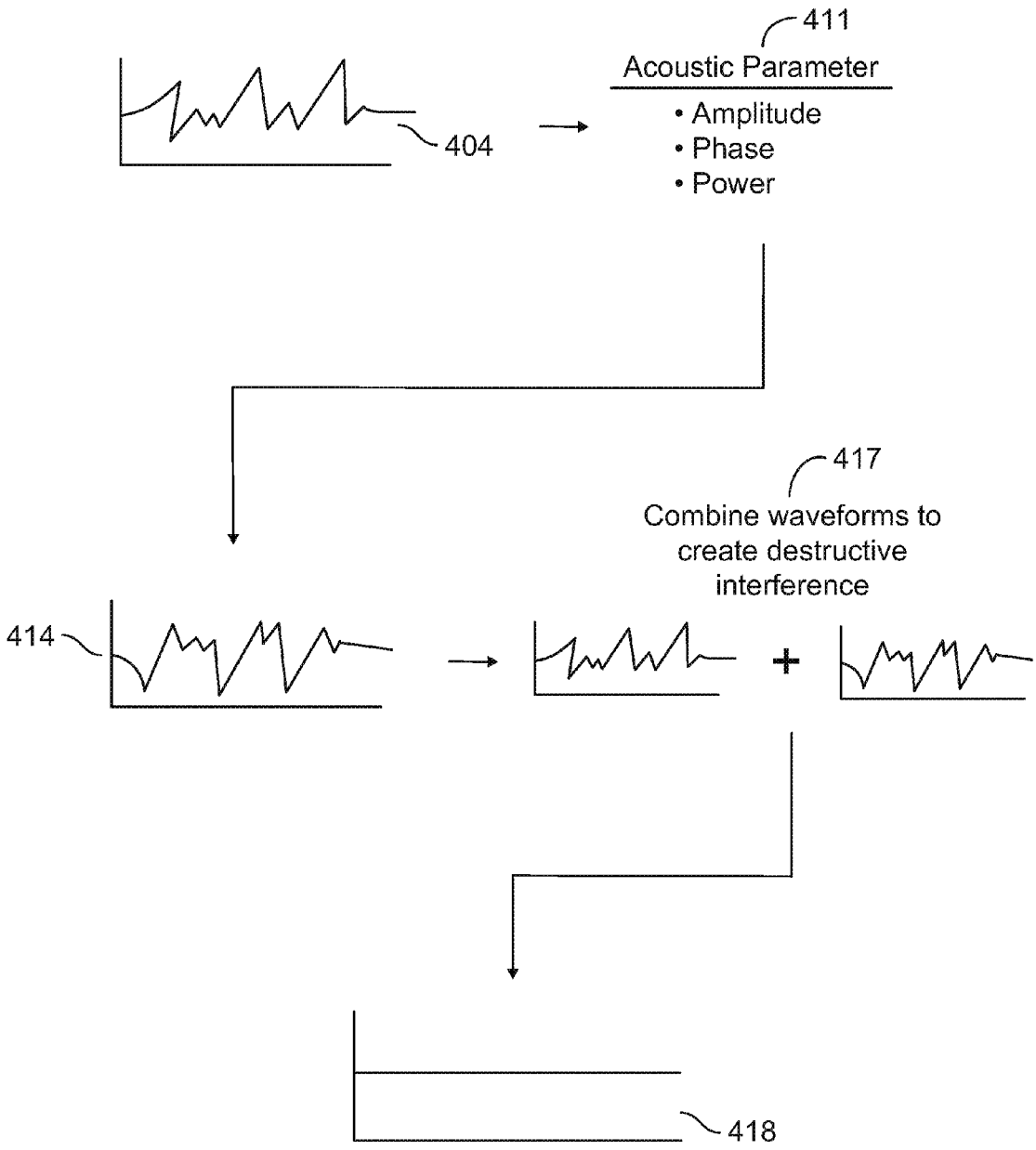
FIG. 6 is a pictorial graphic corresponding to the active sound attenuation method of FIG. 5.

FIG. 5 illustrates a method 400 for active attenuation of the noise vector 266. FIG. 6 is a pictorial graphic corresponding to active attenuation. During operation of the fan unit 232 the noise vector 266 travels from the fan unit 232. At 402, the source microphone 270 detects the noise vector 266. Detecting the noise vector 266 may include detecting a sound pressure, intensity and/or frequency of the noise vector 266. The noise vector is detected as a waveform 404, as shown in FIG. 6.

At 406, environmental noise is removed from the noise vector 266. The noise vector 266 is detected by both the downstream microphone 282 and the upstream microphone 284. The downstream microphone 282 is positioned closer to the fan 226 along the incoming air flow path than the upstream microphone 284. Thus, the downstream microphone 282 acquires the sound measurements from the fan unit 232 a predetermined time period before the same sound measurements are acquired by the upstream microphone 284. The downstream and upstream microphones 282 and 284 sense a common sound at slightly different points in time. The time period between when the downstream and upstream microphones 282 and 284 sense the common sound is determined by the spacing or distance between the downstream and upstream microphones 282 and 284 along the air flow path. A delay corresponding to the time period may be introduced into the signal from the downstream microphone 282. At 406, a difference is obtained between the signals from downstream and upstream microphones 282 and 284. By adjusting the delay, the source microphone 270 is tuned to be sensitive to sound originating from a particular direction.

As such, environmental noise, not generated by the fan unit 232, is filtered from the noise vector at 266 by setting a time delay between the downstream microphone 282 and the upstream microphone 284. Sound pressures received by the upstream microphone 284, not first received by the downstream microphone 282, are indicative of environmental noise that is not generated by the fan 226. Accordingly, the method 400 filters out non-fan unit noises acquired by the source microphone 270. Optionally, if the noise vector 266 is not within an audible range, the signal may be ignored by the attenuating module 276. Once the signals from the microphones 282 and 284 are combined (e.g., subtracted from one another), a filtered fan unit noise signal is produced.

At 410, the filtered fan unit noise is analyzed to obtain values for the acoustic parameters 411 of the sound measurements. The acoustic parameters 411 may be calculated using an algorithm, determined using a look-up table, and/or may be pre-determined and stored in the attenuation module 276. The acoustic parameters of interest may include the frequency, wavelength, period, amplitude, intensity, speed, and/or direction of the filtered fan unit noise. At 412, an attenuation signal 414 is generated. The attenuation signal 414 may be generated by inverting the waveform of the filtered fan unit noise 408. As shown in FIG. 6, the attenuation signal 414 has an equal amplitude and a waveform that is 180 degrees out of phase with the filtered fan unit noise waveform 408.

At 416, the attenuation signal 414 is transmitted to the speaker 274 to generate the attenuation vector 288. The attenuation vector 288 is transmitted downstream in a direction opposite the noise vector 266. The attenuation vector 288 has a matching amplitude and opposite phase in relation to the noise vector 266. Thus, the attenuation vector 288 destructively interferes 417 with the noise vector 266 by reducing the amplitude of the noise vector 266 to approximately zero, as shown at 418 of FIG. 6. It should be noted that the amplitude may be reduced to any range that is inaudible. Optionally, the attenuation vector 288 may reduce or eliminate any other acoustic parameter of the noise vector 266. Further, in the exemplary embodiment, the attenuation vector 288 is timed so that the noise vector 266 is attenuated within the region of active cancellation 268, thereby also eliminating the noise vector 266 upstream of the region of active cancellation 268.

At 420, the response microphone 272 monitors the attenuation of the noise vector 266. In the exemplary embodiment, the response microphone 272 monitors the attenuation in real-time. As used herein real-time refers to actively monitoring the attenuation as the attenuation vector 288 is transmitted from the speaker 274.

At 422, the response microphone 272 detects the attenuated noise vector 290. At 424, the attenuated noise vector 290 is compared to the noise vector 266 to provide a dynamic feedback loop that adjusts and tunes the attenuation vector 288.

Figure 7:
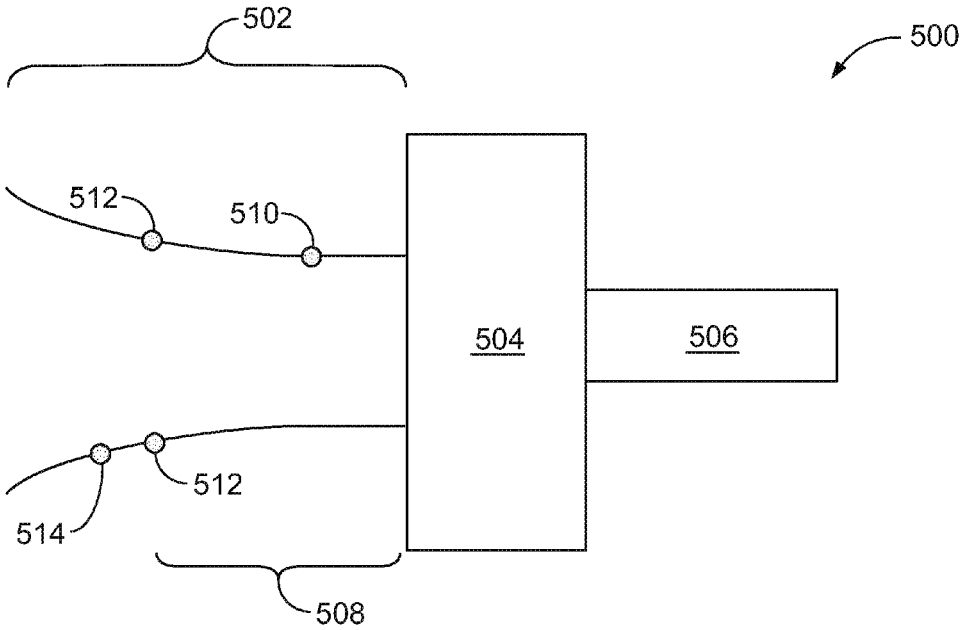
FIG. 7 is a schematic view of a fan unit in accordance with an embodiment.

FIG. 7 illustrates a fan unit 500 in accordance with an embodiment. The fan unit 500 includes an inlet cone 502, a fan assembly 504, and a motor 506. The inlet cone 502 is positioned upstream from the fan assembly 504. The inlet cone 502 includes a throat 508 positioned directly upstream from the fan assembly 504. It should be noted that with respect to airflow "upstream" is defined as traveling from the fan 504 to the inlet cone 502 and "downstream" is defined as traveling from the inlet cone 502 to the fan 504. A source microphone 510 is positioned within the throat 508 of the inlet cone 502. The source microphone 510 may include a pair of microphones. Optionally, the source microphone 510 may include only one microphone. A pair of speakers 512 is positioned upstream from the source microphone 510. Optionally, there may be additional speakers 512. The speakers 512 are positioned within the inlet cone 502. The speakers 512 are aerodynamically configured to limit an effect on the fan performance. In an embodiment, the speakers 512 are positioned within the same cross-sectional plane. Optionally, the speakers 512 may be offset from one another. A response microphone 514 is positioned upstream of the speakers 512. The response microphone 514 is positioned within the inlet cone 502. Optionally, the response microphone 514 may be positioned upstream of the fan unit 500.

Noise generated by the fan 504 travels upstream. The noise is detected by the source microphone 510. In response to the detected noise, the speakers 512 transmit attenuating sound fields configured to destructively interfere with the noise. The result of the destructive interference is detected by the response microphone 514 to provide a feedback loop to the speakers 512.

Figure 8:
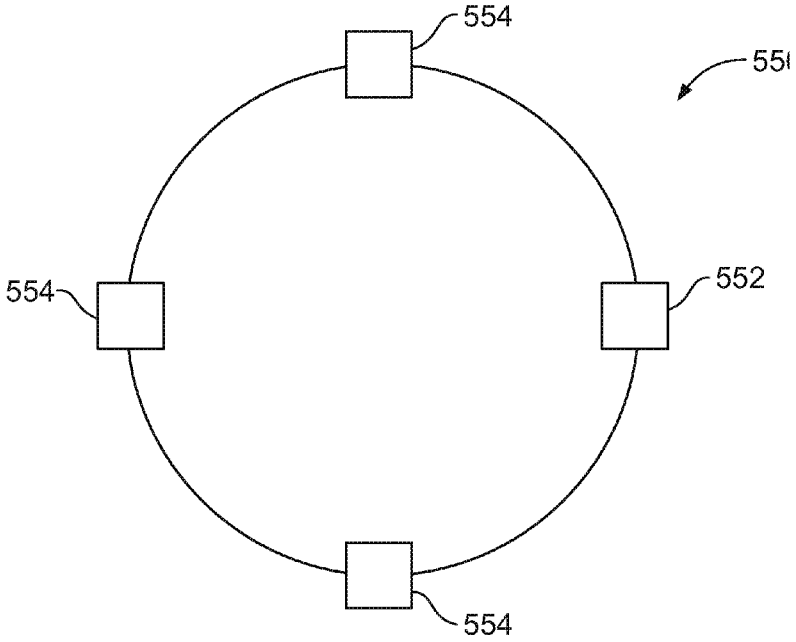
FIG. 8 is a cross-sectional view of an inlet cone in accordance with an embodiment.

FIG. 8 illustrates a cross-section of an inlet cone 550 in accordance with an embodiment. The inlet cone 550 includes a source microphone 552 and speakers 554. The source microphone 552 and the speakers 554 are each positioned 90 degrees from each other. Optionally, the source microphone 552 and the speakers 554 may be positioned along any portion of the inlet cone circumference. Additionally, the inlet cone 550 may include a pair of source microphones 552 and/or any number of speakers 554. In the example embodiment, the source microphone 552 and the speakers 554 are each positioned in the same cross-sectional plane of the inlet cone 550. Optionally, the source microphone 552 and the speakers 554 may be offset from one another.

Noise travels through the inlet cone 550. The noise is detected by the source microphone 552. The speakers then generate an attenuation sound field to destructively interfere with the noise.

Figure 9:
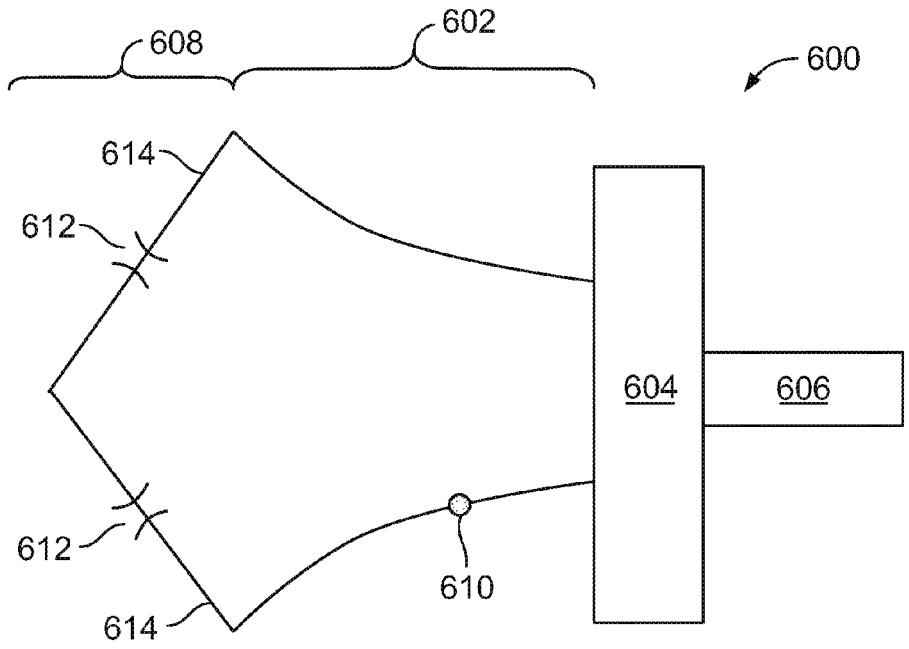
FIG. 9 is a schematic view of a fan unit in accordance with an embodiment.

FIG. 9 illustrates a fan unit 600 in accordance with an embodiment. The fan unit 600 includes an inlet cone 602, a fan assembly 604, and a motor 606. The inlet cone 602 is positioned upstream from the fan assembly 604. An inlet plenum 608 is positioned upstream from the inlet cone 602. It should be noted that with respect to airflow "upstream" is defined as traveling from the fan 604 to the inlet cone 602 and "downstream" is defined as traveling from the inlet cone 602 to the fan 604. A source microphone 610 is positioned within the inlet cone 602. The source microphone 610 may include a pair of microphones. Optionally, the source microphone 610 may include only one microphone. A pair of speakers 612 is positioned within the inlet plenum 608. Optionally, fan unit 600 may include any number of speakers 612. The speakers 612 are aerodynamically configured to limit an effect on the fan performance. The speakers 612 are coupled to a strut 614 that extends through the inlet plenum 608 and across an opening of the inlet cone 602. The strut 614 is angled to angle the speakers 612 with respect to one another. Optionally, the strut may be arced and configured to retain any number of speakers 612.

Noise generated by the fan 604 travels upstream. The noise is detected by the source microphone 610. In response to the detected noise, the speakers 612 transmit attenuating sound fields configured to destructively interfere with the noise.

Figure 10:
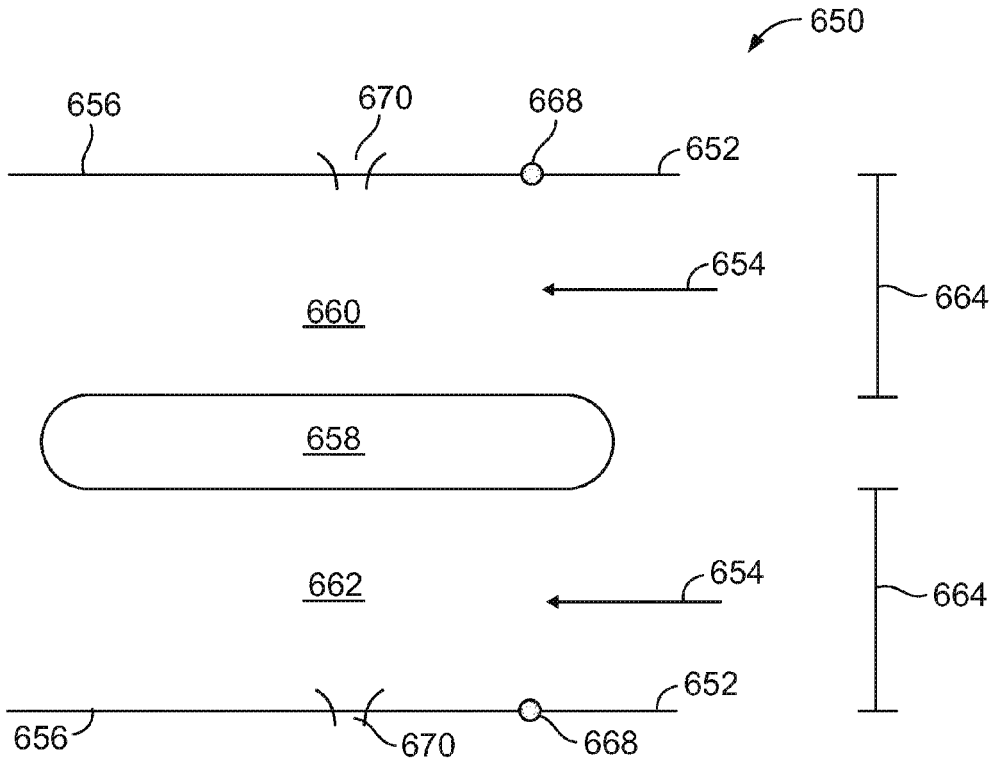
FIG. 10 is a schematic view of an active-passive sound attenuator in accordance with an embodiment.

FIG. 10 illustrates an active-passive sound attenuation system 650 in accordance with an embodiment. The system 650 is positioned within an air plenum 652 having airflow 654 therethrough. The plenum 652 includes a pair of walls 656. The walls 656 are arranged in parallel. Optionally, the walls 656 may be angled with respect to each other to provide a plenum width that converges and/or diverges. A baffle 658 is positioned within the plenum 652. Air channels 660, 662 extend between the baffle 658 and the walls 656. In the exemplary embodiment, air channels 660, 662 have equivalent widths 664. Optionally, the baffle 658 may be positioned so that the widths 664 of channels 660 and 662 differ. The baffle 658 is also positioned in parallel with the walls 656. Optionally, the baffle 658 may be angled with respect to the walls 656. Additionally, the baffle 658 may be rounded and/or have any non-linear shape. The baffles 658 include a sound attenuating material. The sound attenuating material has a porous medium configured to absorb sound. For example, the sound attenuating material may include a fiberglass core.

A source microphone 668 is positioned within each wall 656. Optionally, the source microphone 668 may be positioned in only one wall 656. Alternatively, the source microphone 668 may be positioned within the baffle 658. The source microphone 668 may be positioned upstream from the baffle 658 or, optionally, downstream from the baffle 658. Speakers 670 are positioned within the walls 656. Alternatively, only one speaker 670 may be positioned within the wall. The speaker 670 may also be positioned within the baffle 658. The speaker 670 is positioned downstream from the source microphone 668. In one embodiment, the speaker 670 may be positioned downstream from the baffle 658 and configured to direct attenuating noise in a counter-direction of the airflow 654.

Noise generated within the plenum 652 travels upstream with airflow 654. The baffle 658 provides passive sound attenuation. Additionally, the source microphone 668 detects the noise to provide active sound attenuation. The speakers 670 transmit a sound attenuating noise which destructively interferes with the noise propagating through the plenum 652.

Figure 11:
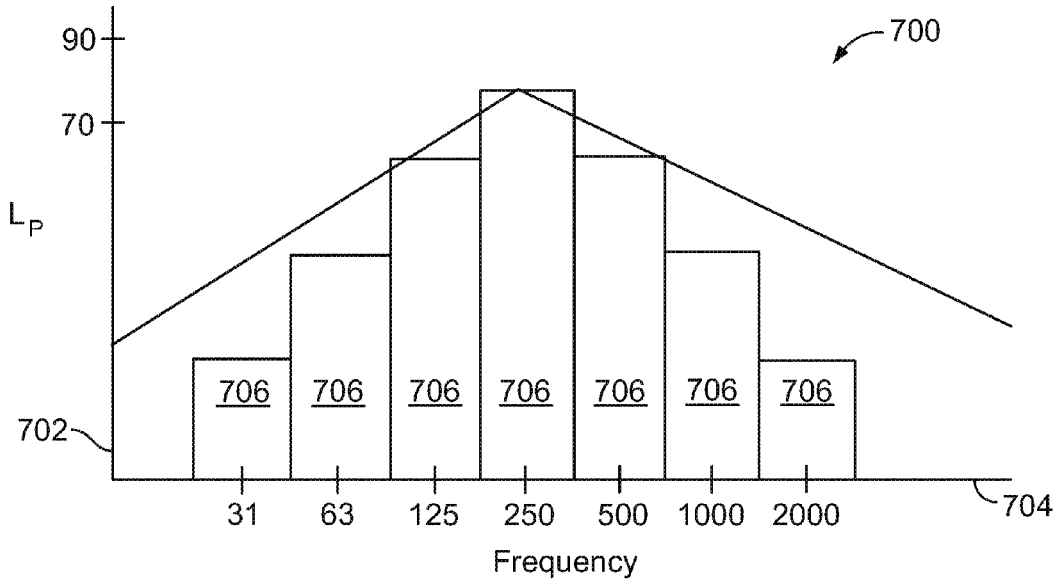
FIG. 11 is a chart illustrating noise frequencies attenuated in accordance with an embodiment.

FIG. 11 is a chart 700 illustrating noise frequencies attenuated in accordance with an embodiment. The chart 700 includes sound pressure (Lp) on the y-axis 702 and frequency on the x-axis 704. Seven octave bands 706 are charted. Each octave band 706 includes a peak frequency. The peak frequencies illustrated are 31 Hz, 63 Hz, 125 Hz, 250 Hz, 500 Hz, 1000 Hz, and 2000 Hz. The dominant noise components generated by a fan array generally have frequencies in common with these peak frequencies. Accordingly, the embodiments described herein are generally configured to attenuate noise propagating at the peak frequencies of octave bands 706. For example, a dominant frequency component of the noise may include the blade pass frequency of the fan. The blade pass frequency is determined using the following:

$$BPF=(RPM*\#\text{ of blades})/60$$

wherein BPF is the blade pass frequency, RPM is the rotations per minute of the fan, and # of blades is the number of fan blades. Typically, the blade pass frequency is approximately 250 Hz. This frequency travels at approximately 70-90 dB. Accordingly, an object of the invention is to attenuate noises within the range of 250 Hz. Although the embodiments are described with respect to attenuating noises having a peak frequency, it should be noted that the embodiments described herein are likewise capable of attenuating any frequency.

Figure 12:
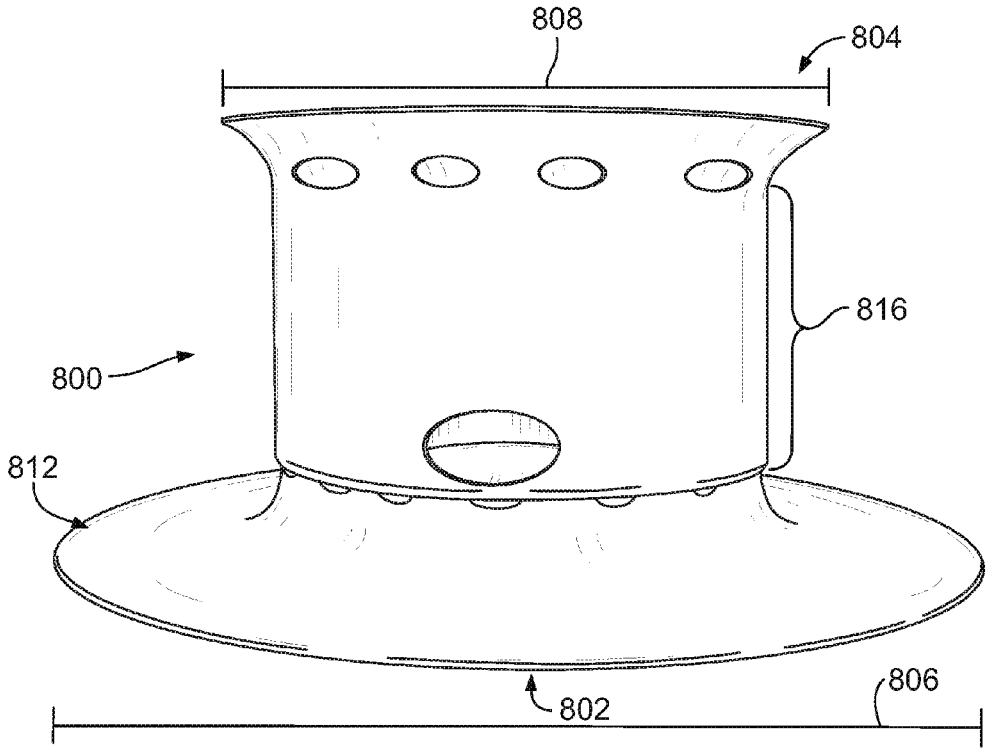
FIG. 12 is a side view of an inlet cone formed in accordance with an embodiment.

FIG. 12 is a side view of an inlet cone 800 formed in accordance with an embodiment. The inlet cone 800 includes an inlet 802 and an outlet 804. In an exemplary embodiment, the inlet 802 and the outlet 804 have a parabolic shape. The inlet 802 has a width 806 that is greater than a width 808 of the outlet 804. The outlet 804 is configured to be positioned adjacent a fan wheel of a fan unit. In one embodiment, the outlet is coupled to the fan wheel. An intermediate portion 810 extends between the inlet 802 and the outlet 804. In the illustrated embodiment, the intermediate portion 810 is cylindrical in shape. In alternative embodiments, the intermediate portion 810 may have any suitable shape.

The intermediate portion 810 includes a plurality of apertures 812 formed therethrough. The apertures 812 are formed in an array around the intermediate portion. The apertures 812 are configured to retain speakers 814 (shown in FIG. 13) therein. The intermediate portion 810 may include any suitable number of apertures 812 for retaining any suitable number of speakers 814. The apertures 812 may be uniformly spaced about the intermediate portion 810. In one embodiment, the inlet cone 800 may includes apertures 812 in the inlet 802 and/or outlet 804.

Figure 13:
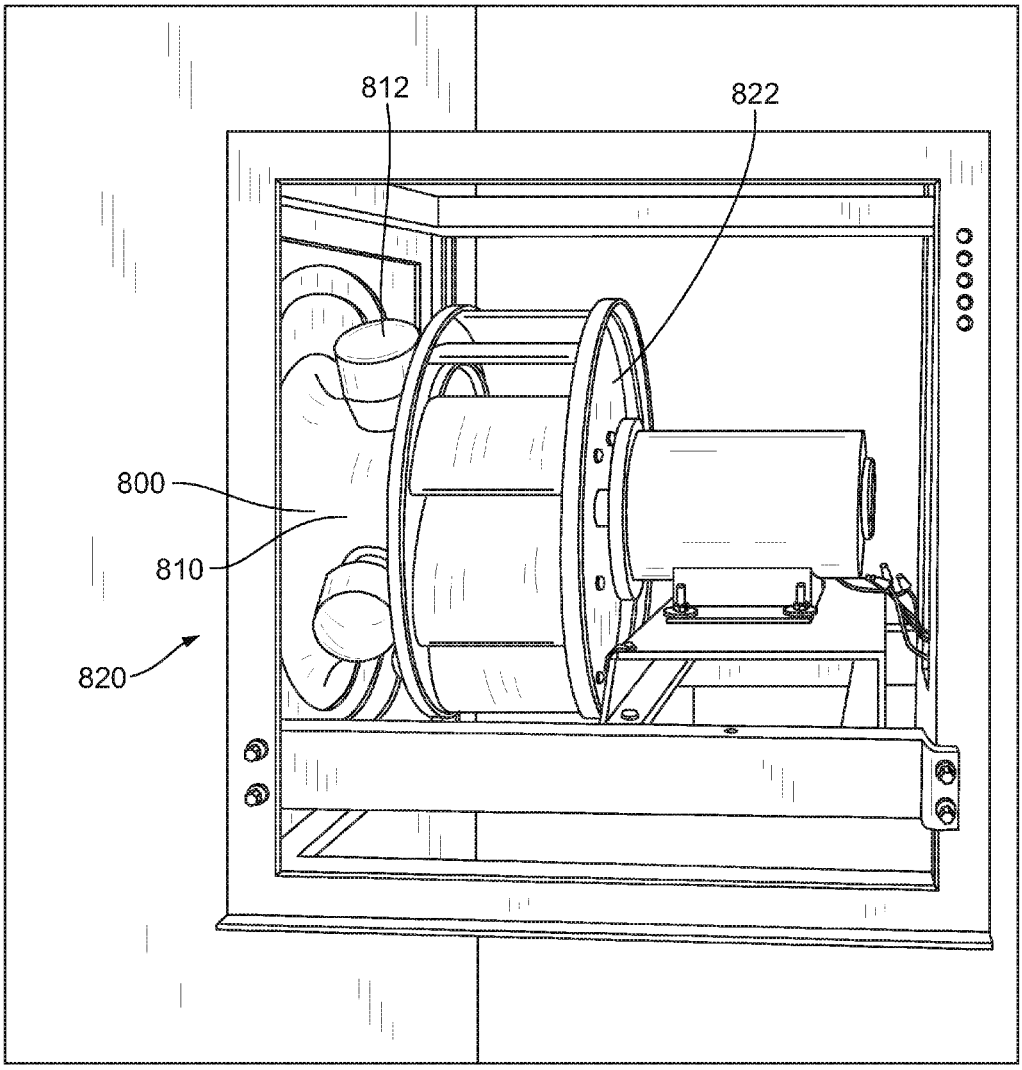
FIG. 13 is a side view of a fan unit formed in accordance with an embodiment.
Figure 14:
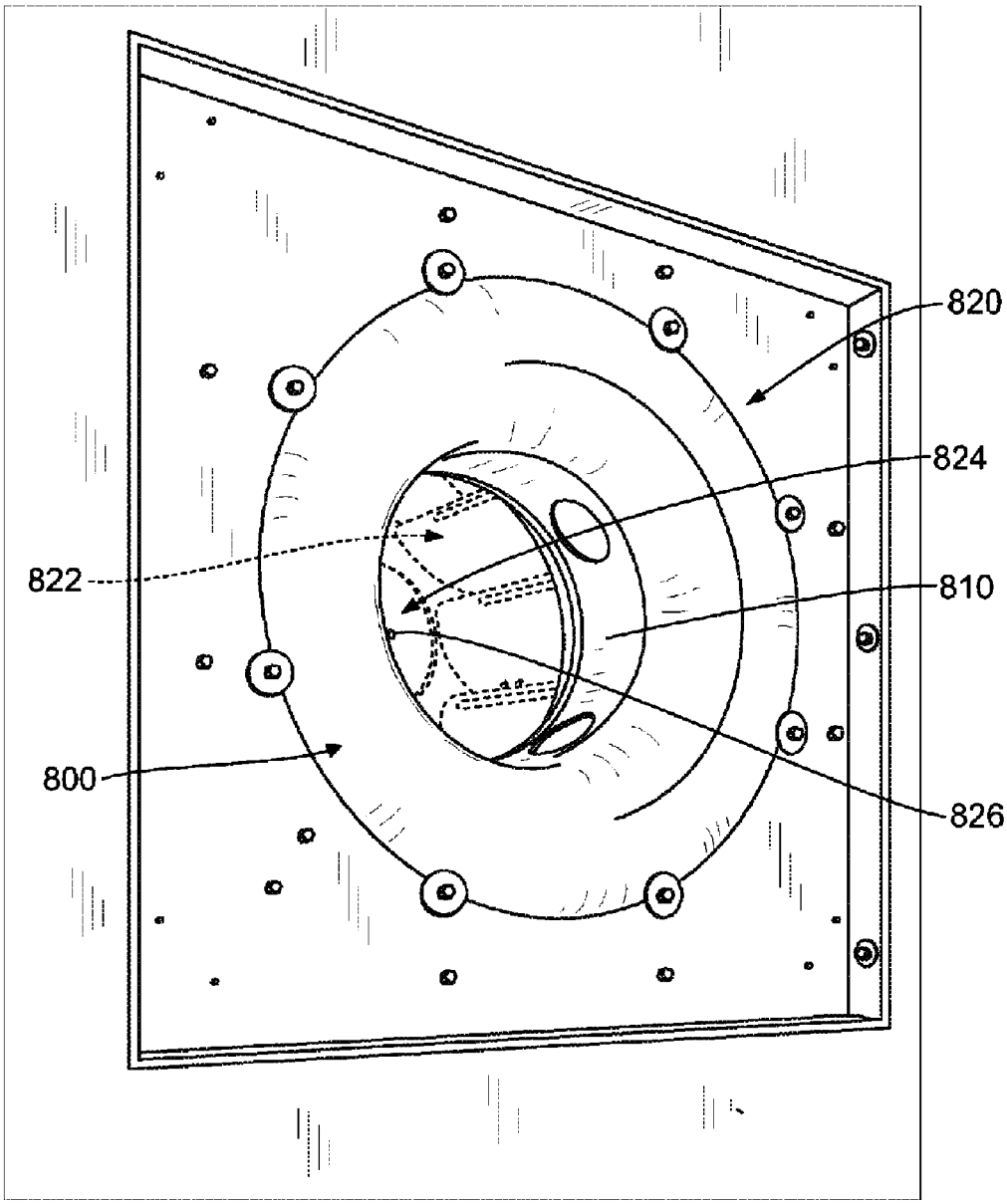
FIG. 14 is a front perspective view of a fan unit formed in accordance with an embodiment.

FIG. 13 is a side view of a fan unit 820 formed in accordance with an embodiment. FIG. 14 is a front perspective view of a fan unit 820. The fan unit 820 includes the inlet cone 800. The inlet cone 800 is joined to the fan wheel 822 of the fan unit 820. Speakers 814 are positioned in the apertures 812 (shown in FIG. 12) of the inlet cone 800. The speakers 814 are arranged in an array around the circumference of the inlet cone 800. The speakers 814 are arranged in an array around the circumference of the intermediate portion 810 of the inlet cone 800.

Figure 15:
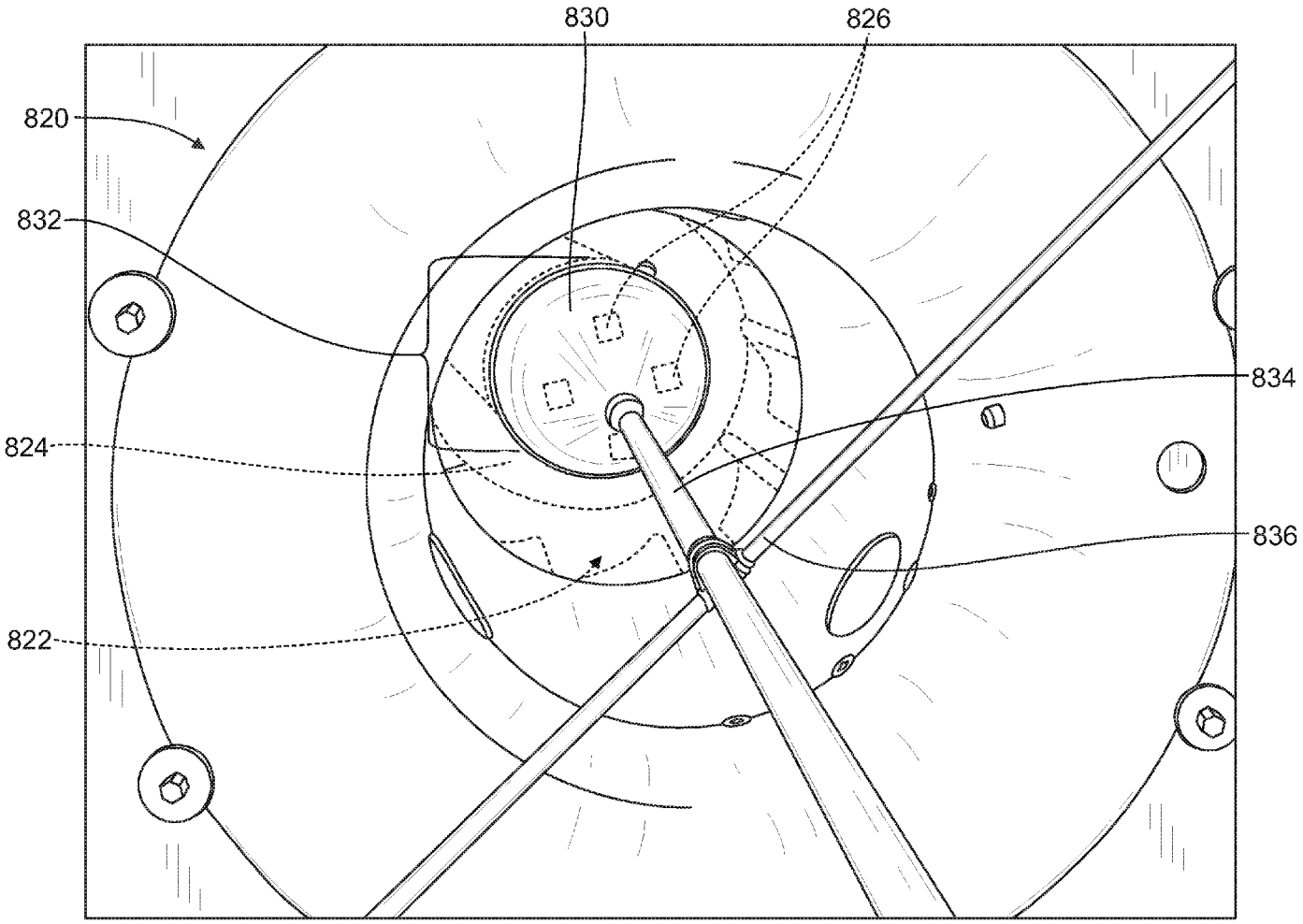
FIG. 15 is a front perspective view of the fan unit formed in accordance with an embodiment and having a microphone positioned therein.

FIG. 15 is a front perspective view of the fan unit 820 having a microphone 826 positioned therein. The fan wheel 822 includes a hub 824 having fan blades 828 extending therefrom. In an exemplary embodiment, a microphone assembly 832 is positioned with the hub 824 of the fan wheel 822. The microphone 826 is positioned within the microphone assembly 832. The illustrated embodiment includes four microphones 826 positioned in an array within the microphone assembly 832. In alternative embodiments, the fan unit 820 may include any number of microphones 826 arranged in any manner. For example, the fan unit 820 may include a single microphone 826 centered in the hub 824.

The microphone assembly 832 includes a cover 830 is positioned over the microphones 826. The cover 830 may be inserted into the hub 824 of the fan wheel 822. The cover 830 may abut the hub 824 of the fan wheel 822 in alternative embodiments. The cover 830 may be formed from a perforated material to allow sound waves to pass therethrough. The cover 830 may be formed from foam or the like in some embodiments. The cover 830 limits air flow to the microphones 826 while allowing sound waves to propagate to the microphones 826. The microphones 826 are configured to collect sound measurements from the fan unit 820. In response to the sound measurements, the array of speakers 814 generates a cancellation signal.

In the illustrated embodiment, the microphone assembly 832 is supported by a boom 834. The boom 834 retains the microphone assembly 832 within the hub 824 of the fan wheel 822. The boom 834 enables the fan wheel 822 to rotate with disturbing a position of the microphone assembly 832. The boom 834 is joined to a support beam 836 that retains a position of the boom 834 and the microphone assembly 832.

The embodiments described herein are described with respect to an air handling system. It should be noted that the embodiments described may be used within the air handling unit and/or in the inlet or discharge plenum of the air handling system. The embodiments may also be used upstream and/or downstream of the fan array within the air handling unit. Optionally, the described embodiments may be used in a clean room environment. The embodiments may be positioned in the discharged plenum and/or the return chase of the clean room. Optionally, the embodiments may be used in residential HVAC systems. The embodiments may be used in the ducts of an HVAC system. Optionally, the embodiments may be used with precision air control systems, DX and chilled-water air handlers, data center cooling systems, process cooling systems, humidification systems, and factory engineered unit controls. Optionally, the embodiments may be used with commercial and/or residential ventilation products. The embodiments may be used in the hood and/or inlet of the ventilation product. Optionally, the embodiments may be positioned downstream of the inlet in a duct and/or at a discharge vent.

The various embodiments described herein enable active monitoring of noise generated by a fan unit. By actively monitoring the noise, an attenuation signal is dynamically generated to cancel the noise. The attenuation signal is generated by inverting a noise signal acquired within the fan unit. Accordingly, attenuation is maximized by matching the amplitude of the noise signal. Additionally, the attenuation signal is configured to destructively interfere with the noise within a range defined inside the fan unit cone. As a result, the noise generated by the fan is attenuated prior to exiting the fan unit. The response microphone enables continual feedback of the attenuation, thereby promoting the dynamic changes of the system.

The various embodiments and/or components, for example, the modules, or components and controllers therein, also may be implemented as part of one or more computers or processors. The computer or processor may include a computing device, an input device, a display unit and an interface, for example, for accessing the Internet. The computer or processor may include a microprocessor. The microprocessor may be connected to a communication bus. The computer or processor may also include a memory. The memory may include Random Access Memory (RAM) and Read Only Memory (ROM). The computer or processor further may include a storage device, which may be a hard disk drive or a removable storage drive such as a floppy disk drive, optical disk drive, and the like. The storage device may also be other similar means for loading computer programs or other instructions into the computer or processor.

As used herein, the term "computer" or "module" may include any processor-based or microprocessor-based system including systems using microcontrollers, reduced instruction set computers (RISC), ASICs, logic circuits, and any other circuit or processor capable of executing the functions described herein. The above examples are exemplary only, and are thus not intended to limit in any way the definition and/or meaning of the term "computer".

The computer or processor executes a set of instructions that are stored in one or more storage elements, in order to process input data. The storage elements may also store data or other information as desired or needed. The storage element may be in the form of an information source or a physical memory element within a processing machine.

The set of instructions may include various commands that instruct the computer or processor as a processing machine to perform specific operations such as the methods and processes of the various embodiments of the invention. The set of instructions may be in the form of a software program. The software may be in various forms such as system software or application software. Further, the software may be in the form of a collection of separate programs or modules, a program module within a larger program or a portion of a program module. The software also may include modular programming in the form of object-oriented programming. The processing of input data by the processing machine may be in response to operator commands, or in response to results of previous processing, or in response to a request made by another processing machine.

As used herein, the terms "software" and "firmware" are interchangeable, and include any computer program stored in memory for execution by a computer, including RAM memory, ROM memory, EPROM memory, EEPROM memory, and non-volatile RAM (NVRAM) memory. The above memory types are exemplary only, and are thus not limiting as to the types of memory usable for storage of a computer program.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the invention without departing from their scope. While the dimensions and types of materials described herein are intended to define the parameters of the various embodiments of the invention, the embodiments are by no means limiting and are exemplary embodiments. Many other embodiments will be apparent to those of skill in the art upon reviewing the above description. The scope of the various embodiments of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments of the invention, including the best mode, and also to enable any person skilled in the art to practice the various embodiments of the invention, including making and using any devices or systems and performing any incorporated methods. The patentable scope of the various embodiments of the invention is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. A method for controlling noise produced by an air handling system, comprising:

collecting sound measurements from the air handling system, the sound measurements being defined by acoustic parameters, determining values for the acoustic parameters based on the sound measurements collected;

calculating offset values for the acoustic parameters, the offset values defining a cancellation signal that at least partially cancels out the sound measurements;

generating the cancellation signal based on the offset values with an array of speakers positioned around a circumference of an inlet cone;

collecting response sound measurements at a region of cancellation; and tuning the cancellation signal based on the response sound measurements.

2. The method of claim 1, further comprising collecting sound measurements with a microphone positioned in a hub of a fan wheel.

3. The method of claim 1, further comprising collecting sound measurements generated within a fan wheel.

4. The method of claim 1, wherein the acoustic parameters include a frequency and amplitude of the sound measurements, and the calculating operation further comprises calculating an opposite phase and matching amplitude of the acoustic parameters.

5. The method of claim 1, wherein generating a cancellation signal further comprises generating a cancellation signal in a direction opposite the sound measurements of the air handling system.

6. The method of claim 1, wherein the cancellation signal destructively interferes with the sound measurements of the air handling system.

7. The method of claim 1, wherein the noise of the air handling system includes a blade pass frequency of the air handling system.

8. The method of claim 1, wherein collecting sound measurements further comprises filtering ambient noise from the sound measurements.

9. The method of claim 1, wherein the generating the cancellation signal further comprises generating a cancellation signal from a plurality of speakers.

10. The method of claim 1, wherein collecting sound measurements further comprises collecting sound measurements in an inlet cone of the air handling system.

11. A system for controlling noise produced by an air handling system, comprising:

a source microphone to collect sound measurements from the air handling system;

a module to define a cancellation signal that at least partially cancels out the sound measurements;

an array of speakers positioned around a circumference of an inlet cone of a fan unit to generate the cancellation signal;

wherein the sound measurements are at least partially canceled out within a region of cancellation, the system further comprising a response microphone to collect response sound measurements at the region of cancellation; and wherein the module tunes the cancellation signal based on the response sound measurements.

12. The system of claim 11, wherein the source microphone is positioned in a hub of a fan wheel.

13. The system of claim 11, wherein the source microphone is supported on a boom that extends into a hub of a fan wheel.

14. The system of claim 11 further comprising a cover positioned over the source microphone to limit air flow to the source microphone.

15. The system of claim 14, wherein sound waves pass through the cover.

16. The system of claim 11, wherein the source microphone collects sound measurements from a fan wheel.

17. The system of claim 11, wherein the speaker generates the cancellation signal in a direction opposite the sound measurements.

18. The system of claim 11, wherein the response microphone includes a pair of microphones to filter ambient noise.

19. The system of claim 11, wherein the source microphone is positioned within an inlet cone of the air handling system.

20. The system of claim 11, wherein the speaker comprises an aerodynamic surface to reduce an effect of the speaker on the air handling system performance.

21. The system of claim 11, further comprising a sound attenuating device to passively cancel the sound measurements.

22. A fan unit, comprising:

a source microphone to collect sound measurements from the fan unit;

a module to define a cancellation signal that at least partially cancels out the sound measurements;

an inlet cone and an array of speakers positioned around a circumference of the inlet cone to generate the cancellation signal;

wherein the sound measurements are at least partially canceled out within a region of cancellation, the fan unit further comprising a response microphone to collect response sound measurements at the region of cancellation; and wherein the module tunes the cancellation signal based on the response sound measurements.

23. The fan unit of claim 22, further comprising a fan wheel, the source microphone positioned in a hub of the fan wheel.

24. The fan unit of claim 22, further comprising a fan wheel, the source microphone supported on a boom that extends into a hub of the fan wheel.

25. The fan unit of claim 22, further comprising a cover positioned over the source microphone to limit air flow to the source microphone.

26. The fan unit of claim 25, wherein sound waves pass through the cover.

27. The fan unit of claim 22, further comprising a fan wheel, the source microphone collecting sound measurements from the fan wheel.

28. The fan unit of claim 22, wherein the speaker generates the cancellation signal in a direction opposite the sound measurements.

29. The fan unit of claim 22, wherein the response microphone includes a pair of microphones to filter ambient noise.

30. The fan unit of claim 22, wherein the source microphone is positioned within an inlet cone of the fan unit.

31. The fan unit of claim 22, wherein the speaker comprises an aerodynamic surface to reduce an effect of the speaker on the fan unit.

32. The fan unit of claim 22, further comprising a sound attenuating device to passively cancel the sound measurements.

33. A method, comprising:

positioning a source microphone with respect to a fan unit, wherein the source microphone is configured to collect sound measurements from the fan unit;

positioning an array of speakers around a circumference of an inlet cone of the fan unit, wherein the speakers are configured to generate a cancellation signal;

operatively connecting the source microphone and the speakers to a module that is configured to define the cancellation signal that at least partially cancels out the sound measurements;

positioning a response microphone with respect to the fan unit, wherein the response microphone is configured to collect response sound measurements at a region of cancellation; and tuning the cancellation signal based on the response sound measurements.

34. The method of claim 33, wherein the positioning a source microphone operation comprises positioning the source microphone in a hub of a fan wheel of the fan unit.

35. The method of claim 33, wherein the positioning a source microphone operation comprises supporting the source microphone on a boom that extends into a hub of a fan wheel of the fan unit.

36. The method of claim 33, further comprising positioning a cover over the source microphone to limit air flow to the source microphone.

37. The method of claim 36, wherein the positioning a cover operation comprises allowing sound waves to pass through the cover.

38. The method of claim 33, wherein the positioning a source microphone, the positioning a speaker, and the operating connecting operations are repeated for an array of fan units.

39. The method of claim 33, wherein the positioning a source microphone operation comprises positioning the source microphone within an inlet cone of the fan unit.

40. The method of claim 33, further comprising positioning a sound attenuating device with respect to the fan unit, wherein the sound attenuating device is configured to passively cancel the sound measurements.

41. A system configured to be used in a fan array, the system comprising:

a source microphone configured to collect sound measurements from a fan unit of the fan array;

a module configured to define a cancellation signal that at least partially cancels out the sound measurements;

an inlet cone and an array of speakers positioned around a circumference of the inlet cone configured to generate the cancellation signal;

wherein the sound measurements are at least partially canceled out within a region of cancellation, the system further comprising a response microphone configured to collect response sound measurements at the region of cancellation; and wherein the module is configured to tune the cancellation signal based on the response sound measurements.

42. The system of claim 41, wherein the source microphone is configured to be positioned a hub of a fan wheel.

43. The system of claim 41, wherein the source microphone is configured to be supported on a boom that extends into a hub of a fan wheel.

44. The system of claim 41, further comprising a cover positioned over the source microphone to limit air flow to the source microphone.

45. The system of claim 44, wherein the cover is configured to allow sound waves to pass therethrough.

46. The system of claim 41, wherein the source microphone is configured to collect the sound measurements from a fan wheel.

47. The system of claim 41, wherein the speaker is configured to generate the cancellation signal in a direction opposite the sound measurements.

48. The system of claim 41, wherein the response microphone includes a pair of microphones configured to filter ambient noise.

49. The system of claim 41, wherein the source microphone is configured to be positioned within an inlet cone of the fan unit.

50. The system of claim 41, wherein the speaker comprises an aerodynamic surface configured to reduce an effect of the speaker on the fan unit.

51. The system of claim 41, further comprising a sound attenuating device configured to passively cancel the sound measurements.

* * * * *